US010126705B1

(12) United States Patent
Piening et al.

(10) Patent No.: US 10,126,705 B1
(45) Date of Patent: Nov. 13, 2018

(54) AUTOMATIC LATCHING OF A TONER CARTRIDGE TO AN IMAGING UNIT OF AN ELECTROPHOTOGRAPHIC IMAGE FORMING DEVICE IN RESPONSE TO DETECTION OF AN ERROR CONDITION

(71) Applicant: LEXMARK INTERNATIONAL, INC., Lexington, KY (US)

(72) Inventors: Chad Michael Piening, Lexington, KY (US); Louann Behymer Samuels, Georgetown, KY (US); Curtis Duane Woodson, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 15/592,569

(22) Filed: May 11, 2017

(51) Int. Cl.
*G03G 21/00* (2006.01)
*G03G 21/18* (2006.01)
*G03G 15/00* (2006.01)

(52) U.S. Cl.
CPC ..... *G03G 21/1821* (2013.01); *G03G 15/5012* (2013.01); *G03G 2221/1654* (2013.01); *G03G 2221/1853* (2013.01)

(58) Field of Classification Search
CPC ..... G03G 15/5012; G03G 15/70; G03G 21/1821; G03G 2221/1654; G03G 2221/1853
USPC ..... 399/21, 25, 113
See application file for complete search history.

(56) References Cited

U.S. PATENT DOCUMENTS

| | | | | |
|---|---|---|---|---|
| 6,384,940 | B1 * | 5/2002 | Kawai | H04N 1/00538 358/474 |
| 6,678,489 | B1 | 1/2004 | Carter et al. | |
| 6,871,031 | B2 | 3/2005 | Blaine et al. | |
| 7,260,342 | B2 * | 8/2007 | Nishimura | G03G 15/0813 399/111 |
| 8,744,287 | B2 * | 6/2014 | Takahashi | G03G 15/556 399/120 |
| 8,761,634 | B2 * | 6/2014 | Mori | G03G 21/1846 399/113 |
| 9,213,303 | B2 | 12/2015 | Maul | |
| 9,285,758 | B1 | 3/2016 | Boettcher et al. | |
| 9,291,992 | B1 | 3/2016 | Boettcher et al. | |
| 2002/0037178 | A1 * | 3/2002 | Saitoh | G03G 21/1647 399/110 |

* cited by examiner

*Primary Examiner* — Robert Beatty

(57) ABSTRACT

An imaging system for an electrophotographic image forming device according to one example embodiment includes a movable latch positioned to selectively couple a replaceable toner cartridge and a replaceable imaging unit together such that the toner cartridge and the imaging unit are removable from the image forming device as a single unit and to selectively decouple the toner cartridge and the imaging unit such that the toner cartridge and the imaging unit are separately removable from the image forming device. A controller is configured to actuate the latch to couple the toner cartridge and the imaging unit together in response to the controller detecting an error condition requiring removal of both the toner cartridge and the imaging unit from the image forming device in order to permit removal of the toner cartridge and the imaging unit from the image forming device as a single unit.

21 Claims, 11 Drawing Sheets

AUTOMATIC LATCHING OF A TONER CARTRIDGE TO AN IMAGING UNIT OF AN ELECTROPHOTOGRAPHIC IMAGE FORMING DEVICE IN RESPONSE TO DETECTION OF AN ERROR CONDITION

CROSS REFERENCES TO RELATED APPLICATIONS

None.

BACKGROUND

1. Field of the Disclosure

The present disclosure relates generally to an electrophotographic image forming device and more particularly to automatic latching of a toner cartridge to an imaging unit of an electrophotographic image forming device in response to detection of an error condition.

2. Description of the Related Art

In order to reduce the premature replacement of components traditionally housed within a toner cartridge for an image forming device, it is now common practice in toner cartridge design to separate components having a longer life from those having a shorter life into separate replaceable units. Relatively longer life components are positioned in one replaceable unit (an imaging unit). The image forming device's toner supply, which is consumed relatively quickly in comparison with the components housed in the imaging unit, is provided in a reservoir in a separate replaceable unit in the form of a toner cartridge that feeds toner to the imaging unit. In this configuration, the number of components housed in the toner cartridge is reduced in comparison with traditional toner cartridges.

Various error conditions in the image forming device may require the removal by the user of both the toner cartridge and the imaging unit in order for the user to access an interior portion of the image forming device to correct the error. The removal of both the toner cartridge and the imaging unit from the image forming device may be cumbersome for the user since the user must set down one or both units in order to free at least one hand to perform corrective actions within the image forming device. The toner cartridge and the imaging unit may also be prone to damage due to user carelessness or inattention when setting down one or both units.

SUMMARY

A replaceable unit for an electrophotographic image forming device according to one example embodiment includes a housing having a reservoir for holding toner. A movable latch on the housing is positioned to engage a corresponding latch catch on a second replaceable unit of the image forming device for selectively coupling and decoupling the replaceable unit and the second replaceable unit such that the replaceable unit and the second replaceable unit are removable from the image forming device as a single unit when the replaceable unit and the second replaceable unit are coupled and the replaceable unit and the second replaceable unit are separately removable from the image forming device when the replaceable unit and the second replaceable unit are decoupled. A drive interface is operatively connected to the latch and exposed on the housing to engage a drive member of the image forming device when the replaceable unit is installed in the image forming device to receive an actuation force from the drive member of the image forming device for actuating the latch to selectively couple and decouple the replaceable unit and the second replaceable unit when the replaceable unit and the second replaceable unit are installed in the image forming device.

An imaging system for an electrophotographic image forming device according to another example embodiment includes a replaceable toner cartridge having a toner reservoir and an outlet in fluid communication with the toner reservoir for exiting toner from the toner cartridge, and a replaceable imaging unit having an inlet for receiving toner from the outlet of the toner cartridge. The imaging system further includes a latch movable between a latched position and an unlatched position. In the latched position, the latch couples the toner cartridge and the imaging unit together such that the toner cartridge and the imaging unit are removable from the image forming device as a single unit. In the unlatched position, the toner cartridge and the imaging unit are decoupled such that the toner cartridge and the imaging unit are separately removable from the image forming device. A latch actuator is operatively engaged with the latch for moving the latch between the latched and unlatched positions. A controller is configured to detect an error condition that requires removal of both the toner cartridge and the imaging unit from the image forming device and, in response to detecting the error condition, to cause the latch actuator to move the latch from the unlatched position to the latched position to permit removal of the toner cartridge and the imaging unit from the image forming device as a single unit.

A method for controlling an imaging system of an electrophotographic image forming device according to another example embodiment includes detecting, by the image forming device, an error condition that requires removal of both a toner cartridge and an imaging unit installed in the image forming device. The method further includes actuating, by the image forming device, a latch between the toner cartridge and the imaging unit to couple the toner cartridge and the imaging unit together such that the toner cartridge and the imaging unit are removable from the image forming device as a single unit in response to detecting the error condition.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
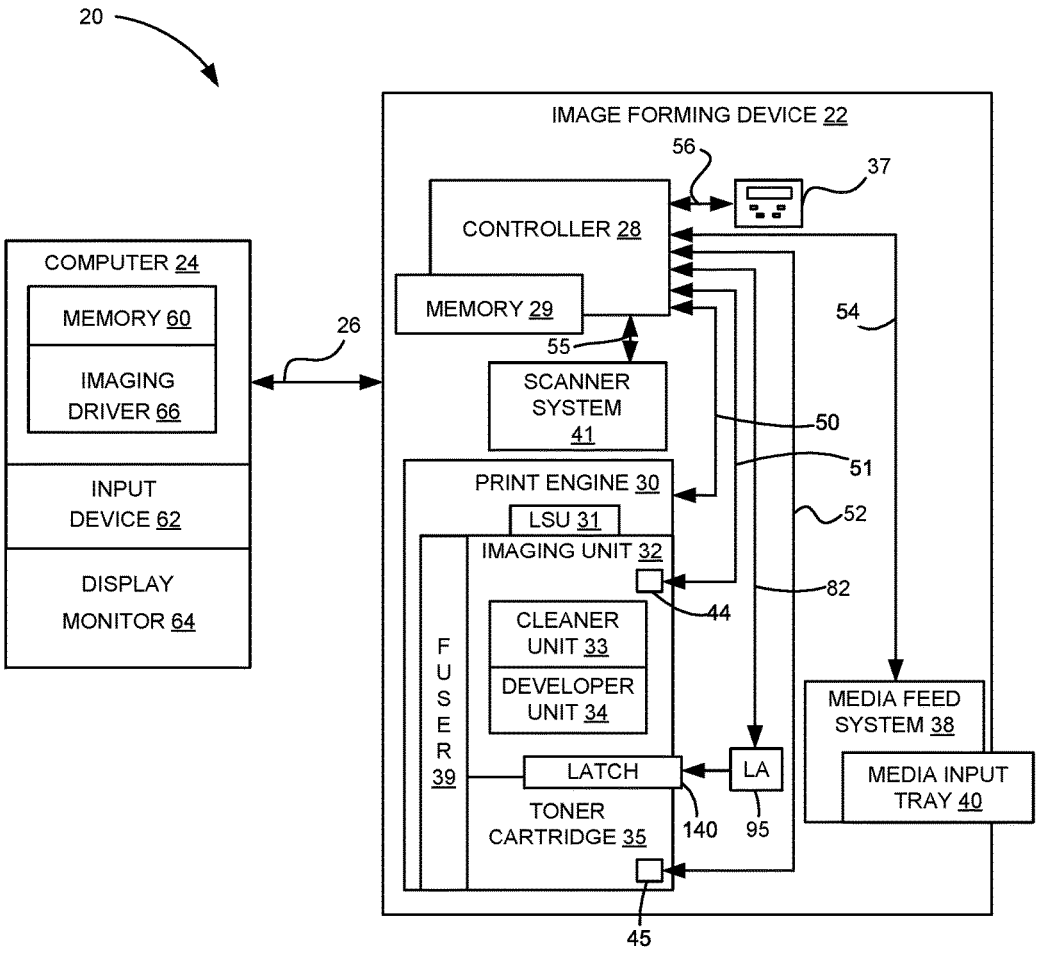
FIG. 1 is a block diagram depiction of an imaging system according to one example embodiment.

Referring now to the drawings and particularly to FIG. 1, there is shown a block diagram depiction of an imaging system 20 according to one example embodiment. Imaging system 20 includes an image forming device 22 and a computer 24. Image forming device 22 communicates with computer 24 via a communications link 26. As used herein, the term "communications link" generally refers to any structure that facilitates electronic communication between multiple components and may operate using wired or wireless technology and may include communications over the Internet.

In the example embodiment shown in FIG. 1, image forming device 22 is a multifunction machine (sometimes referred to as an all-in-one (AIO) device) that includes a controller 28, a print engine 30, a laser scan unit (LSU) 31, an imaging unit 32, a toner cartridge 35, a user interface 37, a media feed system 38, a media input tray 40 and a scanner system 41. Image forming device 22 may communicate with computer 24 via a standard communication protocol, such as, for example, universal serial bus (USB), Ethernet or IEEE 802.xx. Image forming device 22 may be, for example, an electrophotographic printer/copier including an integrated scanner system 41 or a standalone electrophotographic printer.

Controller 28 includes a processor unit and associated electronic memory 29. The processor may include one or more integrated circuits in the form of a microprocessor or central processing unit and may be formed as one or more Application-specific integrated circuits (ASICs). Memory 29 may be any volatile or non-volatile memory or combination thereof, such as, for example, random access memory (RAM), read only memory (ROM), flash memory and/or non-volatile RAM (NVRAM). Memory 29 may be in the form of a separate memory (e.g., RAM, ROM, and/or NVRAM), a hard drive, a CD or DVD drive, or any memory device convenient for use with controller 28. Controller 28 may be, for example, a combined printer and scanner controller.

In the example embodiment illustrated, controller 28 communicates with print engine 30 via a communications link 50. Controller 28 communicates with imaging unit 32 and processing circuitry 44 thereon via a communications link 51. Controller 28 communicates with toner cartridge 35 and processing circuitry 45 thereon via a communications link 52. Controller 28 communicates with media feed system 38 via a communications link 54. Controller 28 communicates with scanner system 41 via a communications link 55. User interface 37 is communicatively coupled to controller 28 via a communications link 56. Controller 28 processes print and scan data and operates print engine 30 during printing and scanner system 41 during scanning. Processing circuitry 44, 45 may provide authentication functions, safety and operational interlocks, operating parameters and usage information related to imaging unit 32 and toner cartridge 35, respectively. Each of processing circuitry 44, 45 includes a processor unit and associated electronic memory. As discussed above, the processor may include one or more integrated circuits in the form of a microprocessor or central processing unit and may be formed as one or more Application-specific integrated circuits (ASICs). The memory may be any volatile or non-volatile memory or combination thereof or any memory device convenient for use with processing circuitry 44, 45.

Computer 24, which is optional, may be, for example, a personal computer, including electronic memory 60, such as RAM, ROM, and/or NVRAM, an input device 62, such as a keyboard and/or a mouse, and a display monitor 64. Computer 24 also includes a processor, input/output (I/O) interfaces, and may include at least one mass data storage device, such as a hard drive, a CD-ROM and/or a DVD unit (not shown). Computer 24 may also be a device capable of communicating with image forming device 22 other than a personal computer such as, for example, a tablet computer, a smartphone, or other electronic device.

In the example embodiment illustrated, computer 24 includes in its memory a software program including program instructions that function as an imaging driver 66, e.g., printer/scanner driver software, for image forming device 22. Imaging driver 66 is in communication with controller 28 of image forming device 22 via communications link 26. Imaging driver 66 facilitates communication between image forming device 22 and computer 24. One aspect of imaging driver 66 may be, for example, to provide formatted print data to image forming device 22, and more particularly to print engine 30, to print an image. Another aspect of imaging driver 66 may be, for example, to facilitate collection of scanned data from scanner system 41.

In some circumstances, it may be desirable to operate image forming device 22 in a standalone mode. In the standalone mode, image forming device 22 is capable of functioning without computer 24. Accordingly, all or a portion of imaging driver 66, or a similar driver, may be located in controller 28 of image forming device 22 so as to accommodate printing and/or scanning functionality when operating in the standalone mode.

Print engine 30 includes a laser scan unit (LSU) 31, toner cartridge 35, imaging unit 32 and a fuser 39, all mounted within image forming device 22. Imaging unit 32 is removably mounted in image forming device 22 and includes a developer unit 34 that houses a toner sump and a toner development system. In one embodiment, the toner development system utilizes what is commonly referred to as a single component development system. In this embodiment, the toner development system includes a toner adder roll that provides toner from the toner sump to a developer roll. A doctor blade provides a metered uniform layer of toner on the surface of the developer roll. In another embodiment, the toner development system utilizes what is commonly referred to as a dual component development system. In this embodiment, toner in the toner sump of developer unit 34 is mixed with magnetic carrier beads. The magnetic carrier beads may be coated with a polymeric film to provide triboelectric properties to attract toner to the carrier beads as the toner and the magnetic carrier beads are mixed in the toner sump. In this embodiment, developer unit 34 includes a magnetic roll that attracts the magnetic carrier beads having toner thereon to the magnetic roll through the use of magnetic fields. Imaging unit 32 also includes a cleaner unit 33 that houses a photoconductive drum and a waste toner removal system.

Toner cartridge 35 is removably mounted in imaging forming device 22 in a mating relationship with developer unit 34 of imaging unit 32. An outlet port on toner cartridge 35 communicates with an inlet port on developer unit 34 allowing toner to be periodically transferred from toner cartridge 35 to resupply the toner sump in developer unit 34.

The electrophotographic printing process is well known in the art and, therefore, is described briefly herein. During a printing operation, laser scan unit 31 creates a latent image on the photoconductive drum in cleaner unit 33. Toner is transferred from the toner sump in developer unit 34 to the latent image on the photoconductive drum by the developer roll (in the case of a single component development system) or by the magnetic roll (in the case of a dual component development system) to create a toned image. The toned image is then transferred to a media sheet received by imaging unit 32 from media input tray 40 for printing. Toner may be transferred directly to the media sheet by the photoconductive drum or by an intermediate transfer member that receives the toner from the photoconductive drum. Toner remnants are removed from the photoconductive drum by the waste toner removal system. The toner image is bonded to the media sheet in fuser 39 and then sent to an output location or to one or more finishing options such as a duplexer, a stapler or a hole-punch.

Image forming device 22 also includes a latch assembly 140 for selectively coupling and decoupling toner cartridge 35 and imaging unit 32 to and from each other. For example, latch assembly 140 may include at least one latch on one of toner cartridge 35 and imaging unit 32 and at least one corresponding latch catch on the other of toner cartridge 35 and imaging unit 32 with each latch engaging a corresponding latch catch to couple toner cartridge 35 and imaging unit 32 together and the latch disengaging the latch catch to decouple toner cartridge 35 and imaging unit 32 from each other. When coupled to each other by latch assembly 140, toner cartridge 35 and imaging unit 32 are locked together such that toner cartridge 35 and imaging unit 32 are removable from image forming device 22 as a single unit. When decoupled from each other, toner cartridge 35 and imaging unit 32 are separately removable from image forming device 22. A latch actuator 95 in image forming device 22 is operatively connected to latch assembly 140 in order to selectively move latch assembly 140 between a latched position and an unlatched position when toner cartridge 35 and imaging unit 32 are installed in image forming device 22. Latch actuator 95 is in operable communication with controller 28 via a communication link 82 allowing controller 28 to control the operation of latch assembly 140.

Image forming device 22 is configured to lock toner cartridge 35 and imaging unit 32 together during certain events or conditions occurring in image forming device 22. For example, image forming device 22 is configured to detect an event, state or condition of image forming device 22 using sensors and to automatically lock toner cartridge 35 and imaging unit 32 together when a detected event or condition requires removal of both toner cartridge 35 and imaging unit 32 from image forming device 22. In one example, controller 28 is configured to detect an error condition relating to a failure in media handling. Examples of such media handling error conditions may include, but are not limited to, a media jam occurring along a media path adjacent to imaging unit 32 and toner cartridge 35, a feed roll stall condition in which a drive motor is turned on to rotate a feed roll but the feed roll is not rotating, a sheet feed stall condition in which a media sheet fails to arrive at a sensor within an allotted time, and a multiple feed sheet condition in which more than one sheet is fed at the same time. Other operating conditions and events not related to media handling failure may require removal of both imaging unit 32 and toner cartridge 35 from image forming device 22. In response to detecting an event, state or condition requiring removal of both imaging unit 32 and toner cartridge 35 from image forming device 22, controller 28 is configured to cause latch actuator 95 to move latch assembly 140 from the unlatched position to the latched position to couple toner cartridge 35 and imaging unit 32 together such that toner cartridge 35 and imaging unit 32 are removable from image forming device 22 as a single unit. Latch assembly 140 may have at least one latch located on toner cartridge 35 and at least one corresponding catch located on imaging unit 32. Conversely, latch assembly 140 may have at least one latch located on imaging unit 32 and at least one corresponding catch located on toner cartridge 35. Any suitable latch and catch configuration may be used for latch assembly 140 and any suitable latch actuator may be used to actuate latch assembly 140 such as motors, solenoids, magnets, etc.

After removal from image forming device 22 as a single unit, both toner cartridge 35 and imaging unit 32 may be reinstalled in image forming device 22 as a single unit. When both imaging unit 32 and toner cartridge 35 are reinstalled in image forming device 22, controller 28 may determine whether or not the error condition has been corrected. In some embodiments, in response to determining that the error condition has been corrected, controller 28 is configured to move latch assembly 140 from the latched position to the unlatched position to unlock or decouple toner cartridge 35 from imaging unit 32 such that toner cartridge 35 and imaging unit 32 are separately removable from image forming device 22.

The latching of latch assembly 140 by controller 28 allows both imaging unit 32 and toner cartridge 35 to be readily removed from image forming device 22 when certain conditions require their removal without the user having to separately remove toner cartridge 35 and imaging unit 32. For example, a user would not have to manually remove both toner cartridge 35 and the imaging unit 32 separately to provide access to interior portions of image forming device 22, such as when clearing jammed media. In addition, because imaging unit 32 and toner cartridge 35 are removable from image forming device 22 as a single unit, the user may use one hand to remove both imaging unit 32 and toner cartridge 35 and have one hand free to perform corrective actions, such as removing jammed media. In this way, the user may not have to set down any of the two units in order to perform corrective actions thereby decreasing the likelihood of damage to toner cartridge 35 and/or imaging unit 32. The unlatching of latch assembly 140 by controller 28 permits the repair, refill or replacement of toner cartridge 35 and imaging unit 32 separately from each other. For example, the unlatching of latch assembly 140 allows toner cartridge 35 to be removed and reinserted easily when replacing an empty toner cartridge 35 without having to remove imaging unit 32.

Figure 2:
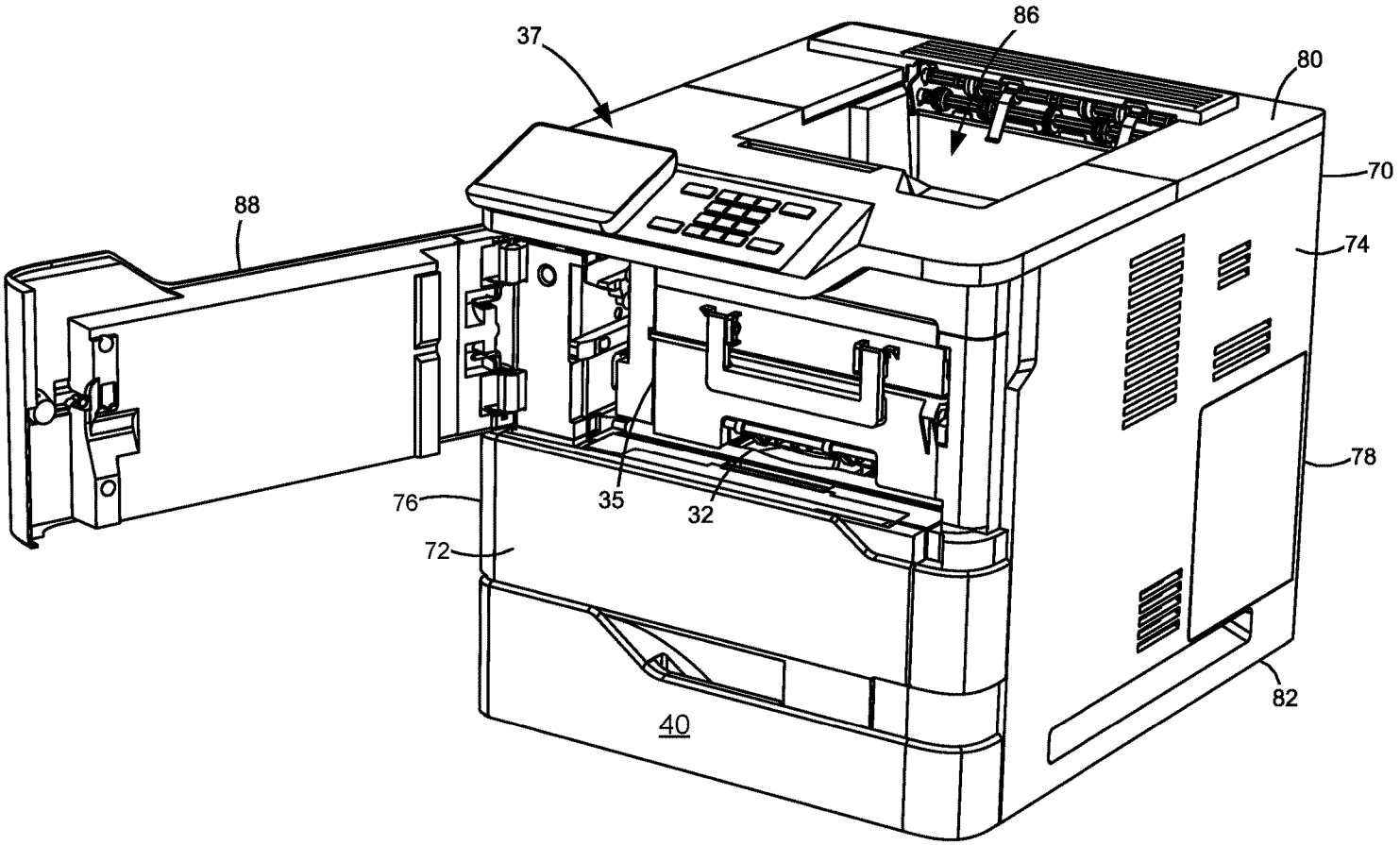
FIG. 2 is a perspective view of an image forming device with an access door of the image forming device opened exposing interior components of the image forming device according to one example embodiment.
Figure 3:
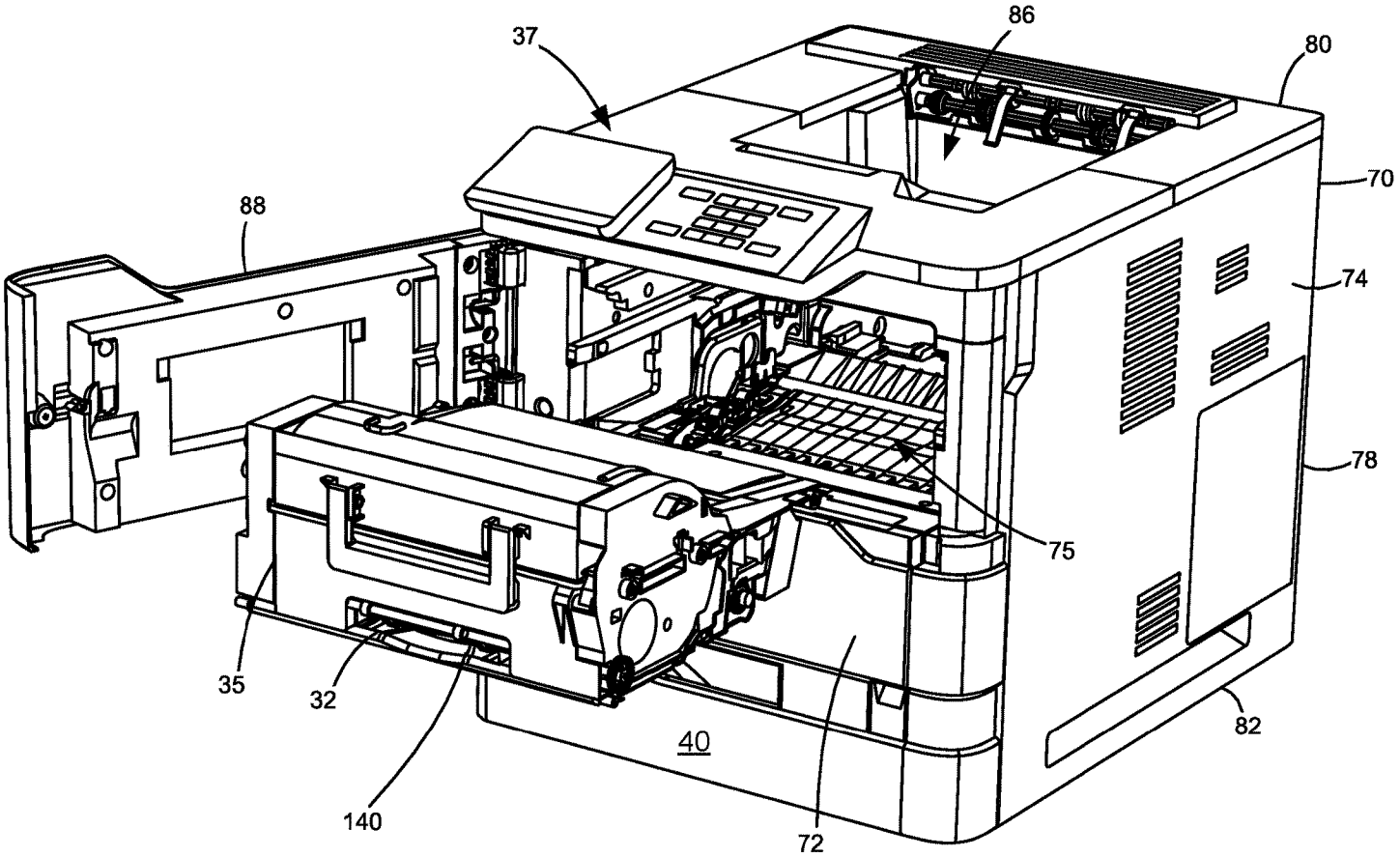
FIG. 3 is a perspective view of the image forming device shown in FIG. 2 with a toner cartridge and an imaging unit removed from the image forming device and latched together as a single unit according to one example embodiment.

FIGS. 2 and 3 illustrate an example embodiment of image forming device 22 having a housing 70 that includes a front 72, first and second sides 74, 76, a rear 78, a top 80 and a bottom 82. A media output area 86 is provided on top 80 of housing 70 for collecting printed media exiting image forming device 22. User interface 37 may be located on the front 72 of housing 70 as illustrated. Using the user interface 37, a user is able to enter commands and generally control the operation of the image forming device 22. Removable media tray 40 for providing media to be printed may be slidably insertable into image forming device 22.

An access door 88 is positioned on housing 70 of image forming device 22 permitting access to interior components of image forming device 22 and allowing the insertion and removal of toner cartridge 35 and imaging unit 32. FIG. 2 shows access door 88 in an open position exposing toner cartridge 35 and imaging unit 32. FIG. 3 shows toner cartridge 35 and imaging unit 32 removed from image forming device 22 exposing a media path 75 within image forming device 22. FIG. 3 also shows toner cartridge 35 and imaging unit 32 coupled to each other by latch assembly 140 such that toner cartridge 35 and imaging unit 32 are removable from image forming device 22 as a single unit.

Figure 4:
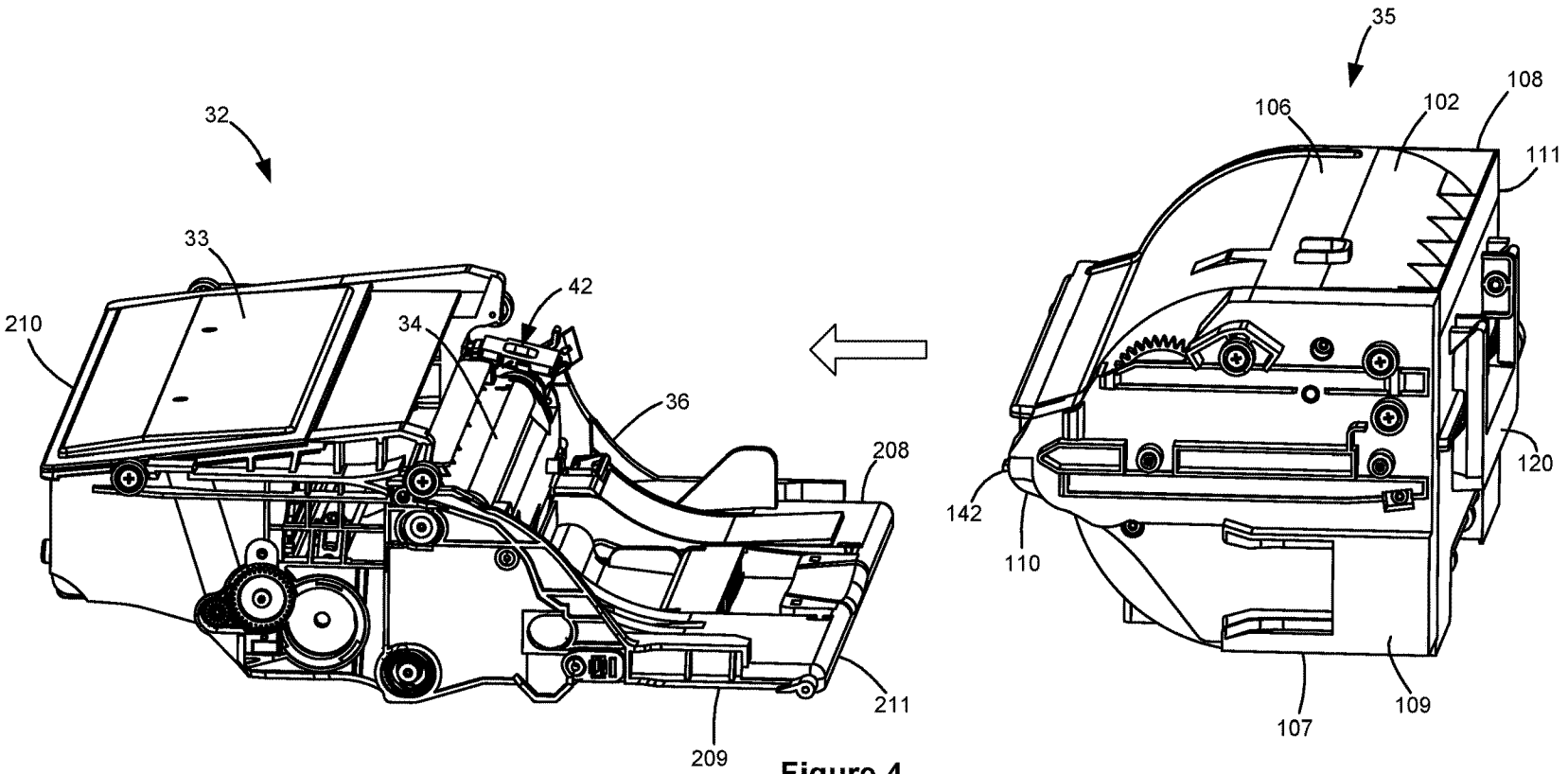
FIG. 4 is a perspective view of the toner cartridge and the imaging unit shown in FIG. 3 separated from each other according to one example embodiment.

Referring now to FIG. 4, toner cartridge 35 and imaging unit 32 are shown according to one example embodiment. Imaging unit 32 includes developer unit 34 and cleaner unit 33 mounted on a common frame 36. Developer unit 34 includes a toner inlet port 42 positioned to receive toner from toner cartridge 35. As discussed above, imaging unit 32 and toner cartridge 35 are each removably installable in image forming device 22. In order to install toner cartridge 35 and imaging unit 32 in image forming device 22, imaging unit 32 is first slidably inserted into image forming device 22 through access door 88. Toner cartridge 35 is then inserted into image forming device 22 through access door 88 and onto frame 36 in a mating relationship with developer unit 34 of imaging unit 32 as indicated by the arrow shown in FIG. 4.

Figure 5:
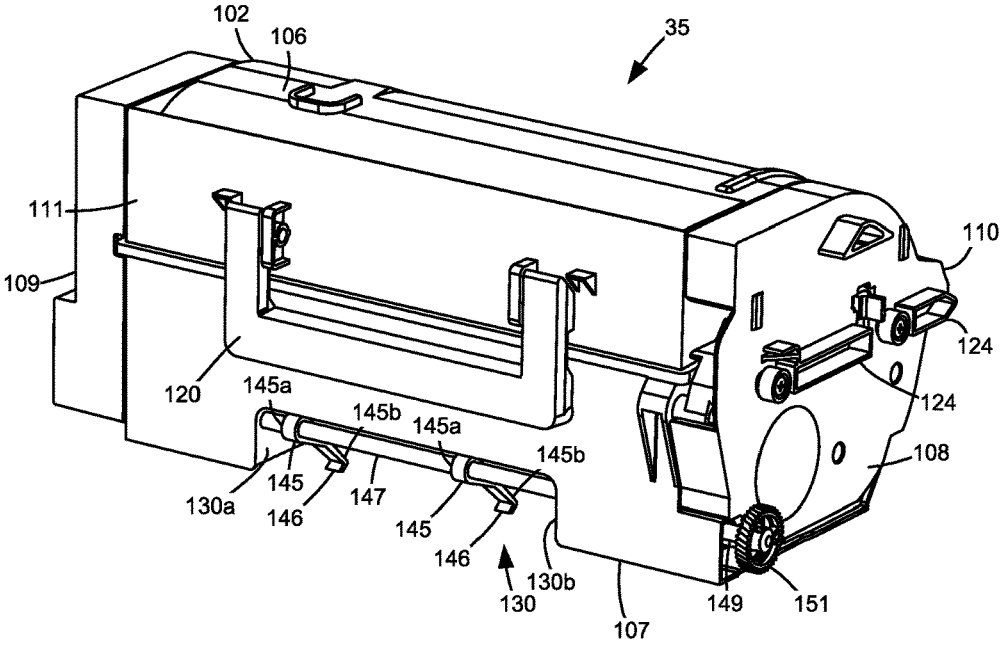
FIGS. 5 and 6 are perspective views of the toner cartridge shown in FIG. 4 according to one example embodiment.
Figure 6:
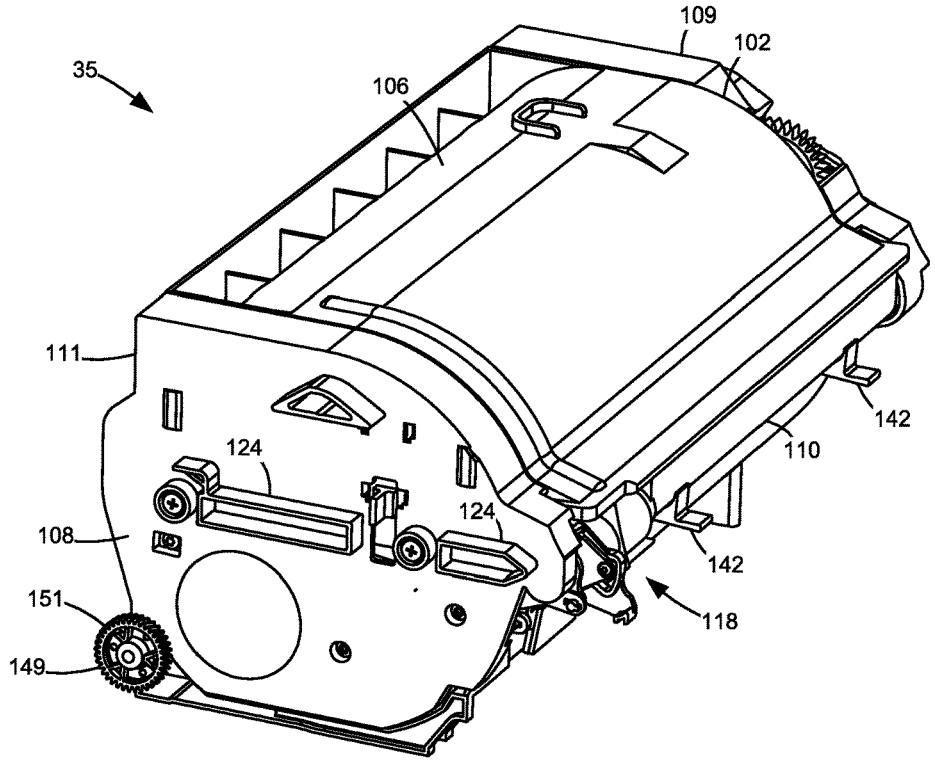

With reference to FIGS. 4-6, toner cartridge 35 includes a housing 102 having an enclosed reservoir for storing toner. Housing 102 includes a top 106, a bottom 107, first and second sides 108, 109, a front 110 and a rear 111. Front 110 of housing 102 leads during insertion of toner cartridge 35 into image forming device 22 and rear 111 trails. An outlet port 118 in fluid communication with the reservoir within housing 102 is positioned on front 110 of housing 102 for exiting toner from toner cartridge 35. A handle 120 may be provided on top 106 or rear 111 of housing 102 to assist with insertion and removal of toner cartridge 35 into and out of image forming device 22.

Sides 108, 109 may each include an alignment guide 124 that extends outward from the respective side 108, 109 to assist the insertion of toner cartridge 35 into image forming device 22. Alignment guides 124 travel in corresponding guide slots in image forming device 22 that guide the insertion of toner cartridge 35 into image forming device 22. Alignment guides 124 may run along a front-to-rear dimension of housing 102 as shown in FIGS. 4-6. However, alignment guide 124 may take many other suitable shapes and forms.

In the example embodiment illustrated in FIGS. 4-6, toner cartridge 35 includes a rotatable latch that engages corresponding catches on imaging unit 32 to lock toner cartridge 35 and imaging unit 32 together to allow removal of toner cartridge 35 and imaging unit 32 from image forming device 22 as a single unit. As shown, toner cartridge 35 includes a shaft 147 that is rotatably mounted within a cavity 130 formed on rear 111 of housing 102. Latch arms 145 extend from shaft 147 within cavity 130. Each latch arm 145 has a first end **145*a* mounted on shaft 147 and a second end 145*b* which is a free end having a hook feature 146. A drive element, such as a drive gear 151, is operatively connected to latch arms 145 via shaft 147 and is positioned on an outer surface of side 108 to mesh with a corresponding drive gear 91 in image forming device 22 when toner cartridge 35 is installed in image forming device 22. In the embodiment illustrated, drive gear 151 is positioned on an end 149 of shaft 147 that extends from cavity 130 toward side 108 of housing 102. Drive gear 91 is driven by latch actuator 95, which, in the example embodiment illustrated, is a drive motor 90 (FIGS. 8 and 9) positioned in image forming device 22. Drive motor 90 provides a rotational actuation force through drive gear 91 and drive gear 151 to move latch arms 145 between a latched position and an unlatched position to selectively engage imaging unit 32 as discussed in greater detail below. Toner cartridge 35 also includes projections 142 on front 110 of housing 102 that aid in retaining imaging unit 32 against toner cartridge 35 when latch arms 145 are engaged with corresponding latch catches on imaging unit 32 as discussed in more detail below. Each projection 142 is shown as a cantilevered flange that extends outward from front 110 of toner cartridge 35. Although the above example embodiment illustrates two projections 142 and two latch arms 145, it will be appreciated that any suitable number of projections 142 and latch arms 145** may be used as desired.

Figure 7:
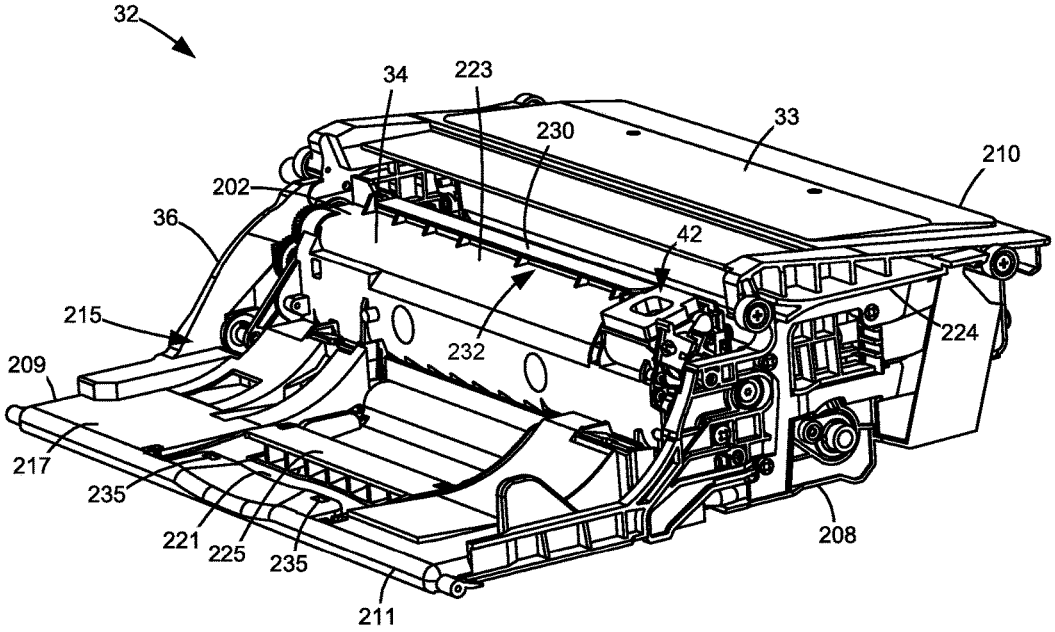
FIG. 7 is a perspective view of the imaging unit shown in FIG. 4 according to one example embodiment.

With reference to FIG. 7, imaging unit 32 includes a housing 202 having an enclosed reservoir for holding toner. Inlet port 42 in fluid communication with the toner reservoir of imaging unit 32 aligns with outlet port 118 of toner cartridge 35 when toner cartridge 35 is installed along frame 36 and mated with developer unit 34. Sides 208, 209 of imaging unit 32 each includes an alignment guide 224 that extends outward from the respective side 208, 209 to assist the insertion of imaging unit 32 into image forming device 22. Alignment guides 224 travel in corresponding guide slots in image forming device 22 that guide the insertion of imaging unit 32 into image forming device 22. Front 210 of imaging unit 32 includes cleaner unit 33, which leads during insertion of imaging unit 32 into image forming device 22. Rear 211 of imaging unit 32, which trails during insertion of imaging unit 32 into image forming device 22, provides a cartridge storage area 215 that is sized and shaped to hold toner cartridge 35. Cartridge storage area 215 is defined by a base 217 that generally conforms to the shape of the exterior surface of bottom 107 of toner cartridge 35. A handle 225 is provided in a recess 221 formed on base 217 of cartridge storage area 215 to assist with the insertion and removal of imaging unit 32 into and out of image forming device 22.

Imaging unit 32 includes latch features that are positioned to interface with the latch features of toner cartridge 35 when toner cartridge 35 is mated with imaging unit 32. In the example shown, openings 235 are provided on base 217 of cartridge storage area 215 to serve as latch catches 235 for respectively receiving hook features 146 of latch arms 145 of toner cartridge 35 when latch arms 145 are in the latched position. Further, a ledge or bracket member 230 is positioned on housing 202 and extends along an upper outer surface 223 of developer unit 34 to generally form an opening or pocket 232 with an open end facing rear 211 of imaging unit 32. The height of bracket member 230 relative to the outer upper surface 223 of developer unit 34 is sized so that projections 142 on toner cartridge 35 pass below bracket member 230 and into pocket 232 when toner cartridge 35 is mated with imaging unit 32. A depth of pocket 232 formed by bracket member 230 is sized so that projections 142 extend sufficiently within pocket 232 to support imaging unit 32 when toner cartridge 35 and imaging unit 32 are removed from image forming device 22 as a single unit.

Figure 8:
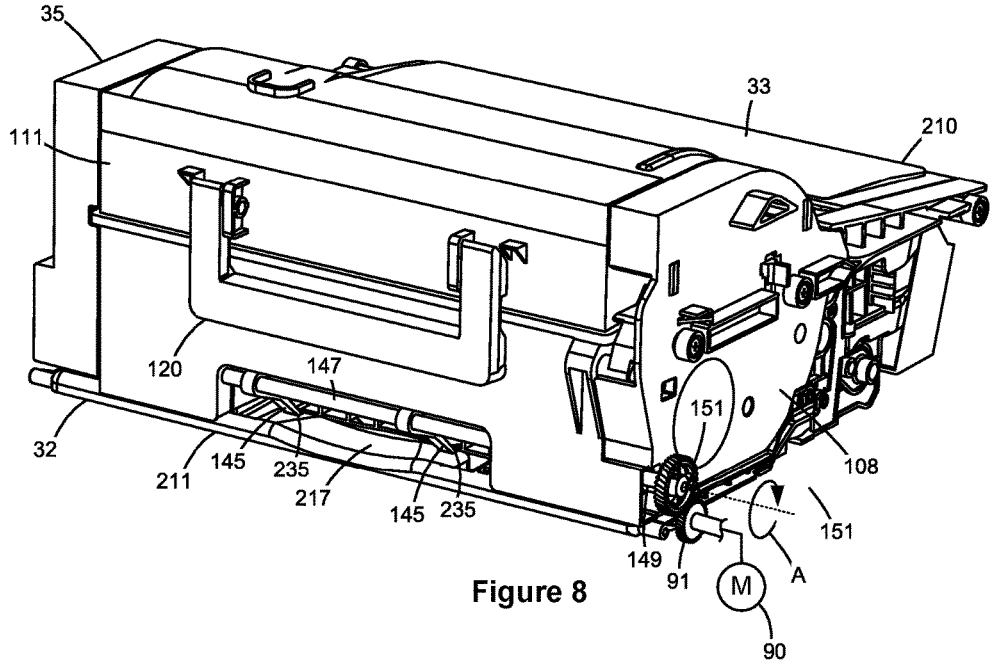
FIGS. 8 and 9 are perspective views of the toner cartridge and the imaging unit latched together according to one example embodiment.
Figure 9:
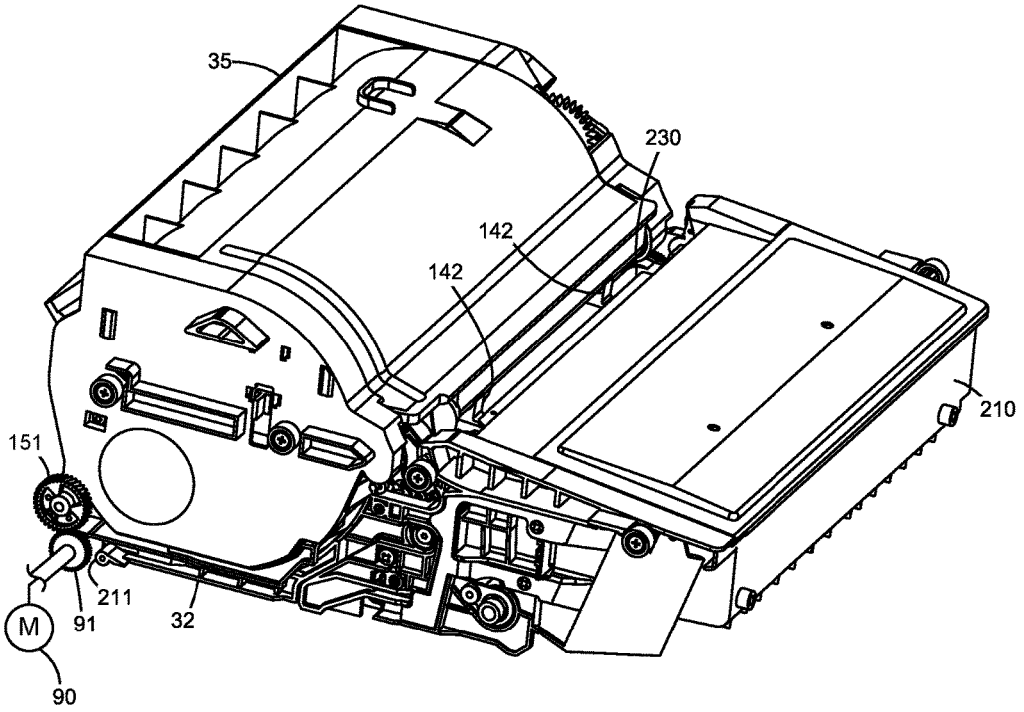

Referring to FIGS. 8 and 9, toner cartridge 35 and imaging unit 32 are shown coupled to each other allowing removal of toner cartridge 35 and imaging unit 32 from image forming device 22 as a single unit. When toner cartridge 35 is installed in image forming device 22 and mated with imaging unit 32, projections 142 on toner cartridge 35 enter pocket 232 below bracket member 230 of imaging unit 32. Latch arms 145 of toner cartridge 35 are initially in the unlatched position, disengaged from corresponding latch catches 235 of imaging unit 32, allowing imaging unit 32 and toner cartridge 35 to be separately removed from image forming device 22. Upon controller 28 detecting an error condition that requires removal of both toner cartridge 35 and imaging unit 32, drive motor 90 rotates drive gear 91 which, in turn, rotates drive gear 151 of toner cartridge 35 in the direction indicated by arrow A in FIG. 8. The rotation of drive gear 151 in the direction indicated by arrow A causes shaft 147 to rotate causing latch arms 145 to move from unlatched positions to latched positions where latch arms 145 engage corresponding latch catches 235 on base 217 of imaging unit 32. Imaging unit 32 and toner cartridge 35 are coupled to each other and removable from image forming device 22 as a single unit once latch arms 145 engage corresponding latch catches 235 of imaging unit 32 and projections 142 are positioned within corresponding pocket 232 of imaging unit 32.

When toner imaging unit 32 and toner cartridge 35 are installed in image forming device 22 (as shown in FIG. 2) and imaging unit 32 and toner cartridge 35 are locked together, a user may remove both imaging unit 32 and toner cartridge 35 as a single unit by slidably pulling toner cartridge 35 rearward in a direction away from imaging unit 32 using handle 120. With the latch features of both imaging unit 32 and toner cartridge 35 engaged with each other, imaging unit 32 is pulled by toner cartridge 35 and prevented from separating from toner cartridge 35 as toner cartridge 35 is removed from image forming device 22. In particular, the engagement between latch arms 145 of toner cartridge 35 and corresponding latch catches 235 of imaging unit 32 causes toner cartridge 35 to pull imaging unit 32 with toner cartridge 35 as toner cartridge 35 is removed from image forming device 22. The engagement between projections 142 of toner cartridge 35 and pocket 232 of imaging unit 32 prevent toner cartridge 35 from lifting up off of base 217 of imaging unit 32 and prevent imaging unit 32 from falling from toner cartridge 35. The user may then insert imaging unit 32 and toner cartridge 35 back into image forming device 22 as a single unit with front 210 of imaging unit 32 leading during the insertion. After reinsertion of toner cartridge 35 and imaging unit 32, drive motor 90 may rotate drive gear 91 causing drive gear 151 of toner cartridge 32 to rotate opposite the direction indicated by arrow A in FIG. 8 causing latch arms 145 of toner cartridge 35 to rotate from the latched positions to the unlatched positions to disengage corresponding latch catches 235 on base 217 of imaging unit 32 permitting removal of toner cartridge 35 and imaging unit 32 separately from image forming device 22.

Figure 10:
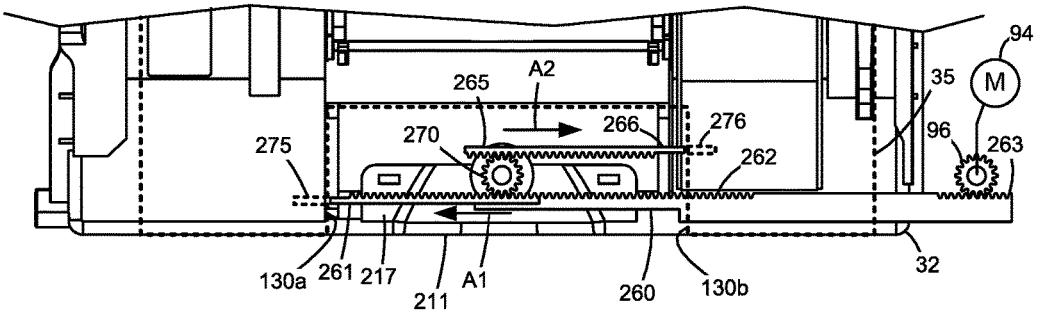
FIG. 10 is a top plan view of a portion of an imaging unit having a slide lock mechanism according to one example embodiment.

With reference to FIG. 10, there is shown a system for locking toner cartridge 35 and imaging unit 32 together to allow removal of toner cartridge 35 and imaging unit 32 from image forming device 22 as a single unit according to another example embodiment. FIG. 10 shows a partial top plan view of imaging unit 32 with toner cartridge 35 installed in imaging unit 32 and depicted in dashed lines. In this embodiment, imaging unit 32 includes a slide lock mechanism having latches that slide into corresponding catches located on toner cartridge 35. In the example shown, imaging unit 32 includes a first rack gear 260 and a second rack gear 265 translatably mounted on base 217 of imaging unit 32 with each of the first and second rack gears 260, 265 having a respective arm or latch end 261, 266. First and second rack gears 260, 265 are operatively coupled to each other via an idler gear 270 rotatably mounted on base 217 of imaging unit 32 such that movement of first rack gear 260 in one direction causes second rack gear 265 to move the same distance traveled by first rack gear 260 in the opposite direction. First rack gear 260 is coupled to a drive gear 96 in image forming device 22 driven by a drive motor 94 for receiving an actuation force from the drive motor and drive gear 96 when imaging unit 32 is installed in image forming device 22. The drive motor 94 is communicatively coupled to and activated by controller 28.

In the example shown, first rack gear 260 includes a first set of gear teeth 262 that meshes with idler gear 270 and a second set of gear teeth 263 that meshes with drive gear 96 when imaging unit 32 is installed in image forming device 22 such that first rack gear 260 is movable sideways depending on the direction of rotation of drive gear 96. When drive gear 96 rotates clockwise as viewed in FIG. 10, the engagement between first and second rack gears 260, 265 via idler gear 270 causes first and second rack gears 260, 265 to translate sideways in opposite directions as indicated by arrows A1, A2 such that their respective latch ends 261, 266 engage corresponding notches 275, 276 formed on opposite side walls 130*a*, 130*b* of cavity 130 of toner cartridge 35 to lock imaging unit 32 and toner cartridge 35 together and allow removal of imaging unit 32 and toner cartridge 35 from image forming device 22 as a single unit. When drive gear 96 rotates counter-clockwise as viewed in FIG. 10, respective latch ends 261, 266 of first and second rack gears 260, 265 disengage from corresponding notches 275, 276 on toner cartridge 35 allowing toner cartridge 35 to be separately removed from imaging unit 32.

Figure 11:
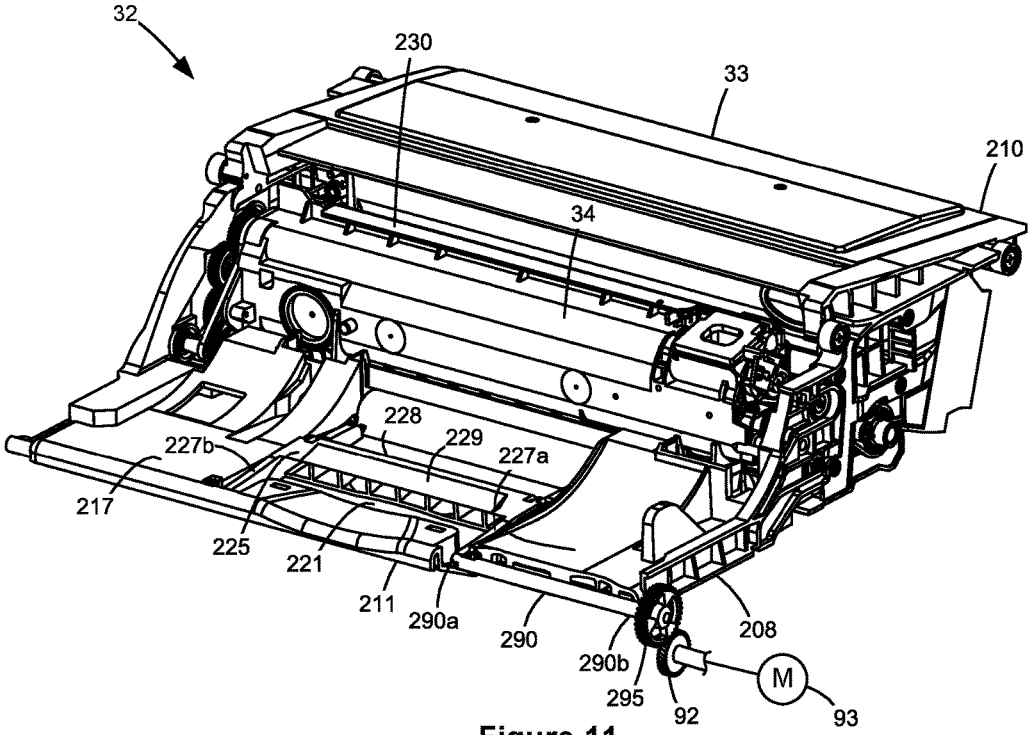
FIG. 11 is a perspective view of an imaging unit having a rotatable handle lock mechanism according to one example embodiment.
Figure 12A:
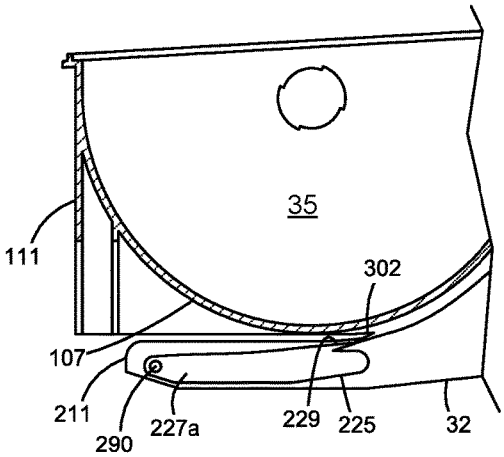
FIGS. 12A and 12B are side views illustrating the handle lock mechanism shown in FIG. 11 in an unlatched position and a latched position, respectively, relative to a toner cartridge according to one example embodiment.
Figure 12B:
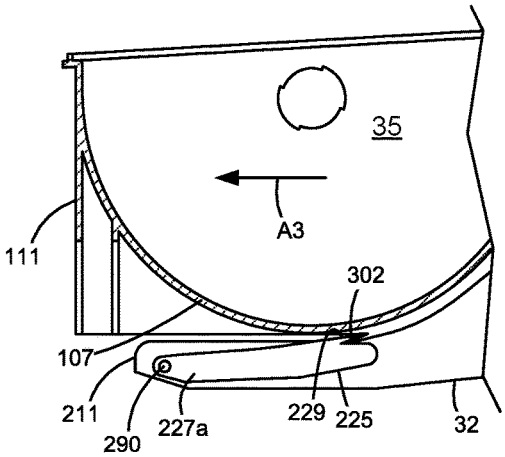

Referring now to FIGS. 11-12B, another example embodiment of a system for locking toner cartridge 35 and imaging unit 32 together is illustrated. FIG. 11 illustrates a perspective view of imaging unit 32 with a portion of rear 211 of imaging unit 32 partially cutout to more clearly illustrate a drive interface. In this embodiment, imaging unit 32 includes a rotatable lock mechanism having latches that rotate to engage corresponding catches located on toner cartridge 35. In the example shown, rotatable handle 225 of imaging unit 32 is configured to selectively engage an exposed portion of bottom 107 of toner cartridge 35 to lock imaging unit 32 and toner cartridge 35 together and allow removal of imaging unit 32 and toner cartridge 35 from image forming device 22 as a single unit. In the example shown, handle 225 includes a pair of arms 227*a*, 227*b* pivotably mounted on base 217 and a grip 228 connecting arms 227*a*, 227*b*. A shaft 290 is rotatably mounted on base 217. Shaft 290 has a first end 290*a* coupled to handle 225 and a second end 290*b* extending towards side 208 of imaging unit 32. Second end 290*b* of shaft 290 includes a drive element, shown as a drive gear 295, positioned to mesh with a corresponding drive gear 92 in image forming device when imaging unit 32 is installed in image forming device 22. Drive gear 92 is driven by a drive motor 93 in image forming device 22. Drive motor 93 is communicatively coupled to and activated by controller 28 and provides an actuation force to rotate handle 225 between an unlatched position shown in FIG. 12A and a latched position shown in FIG. 12B when imaging unit 32 is installed in image forming device 22.

Grip 228 includes an angled flange 229 extending along an upper surface thereof and forming a hook with an open end facing developer unit 34. Bottom 107 of toner cartridge 35 includes a groove 302 having an open end facing rear 111 of toner cartridge 35. In the unlatched position shown in FIG. 12A, angled flange 229 of handle 225 of imaging unit 32 is disengaged from groove 302 of toner cartridge 35 allowing toner cartridge 35 and imaging unit 32 to be separately removed from image forming device 22. In the latched position shown in FIG. 12B, handle 225 of imaging unit 32 is rotated counter-clockwise such that angled flange 229 interlocks with groove 302 on bottom 107 of toner cartridge 35 when toner cartridge 35 is pulled out of image forming device 22 as indicated by arrow A3 so that imaging unit 32 and toner cartridge 35 are coupled to each other and removable from image forming device 22 as a single unit.

Figure 13A:
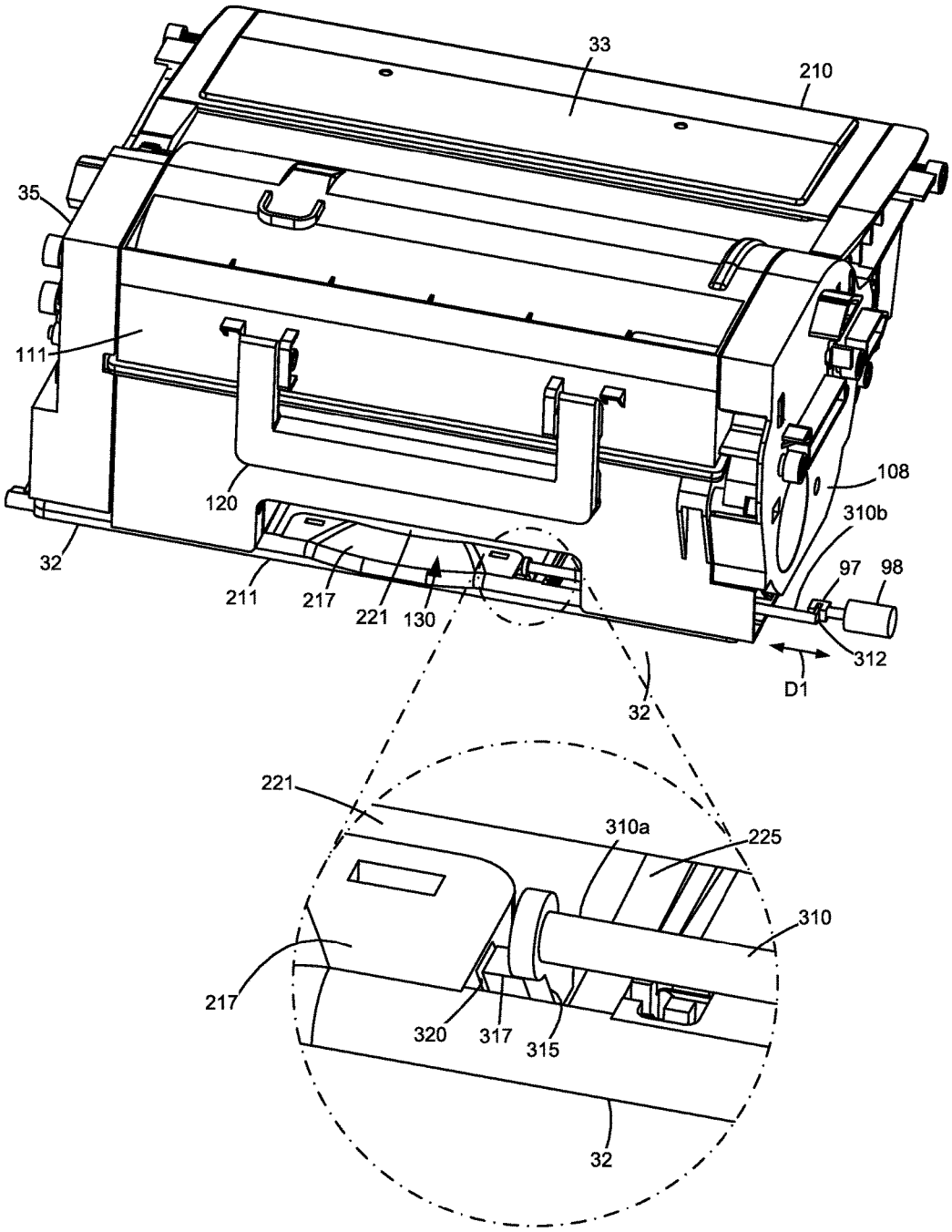
FIGS. 13A and 13B are perspective views illustrating a slide lock mechanism of a toner cartridge in an unlatched position and a latched position, respectively, relative to an imaging unit according to one example embodiment.
Figure 13B:
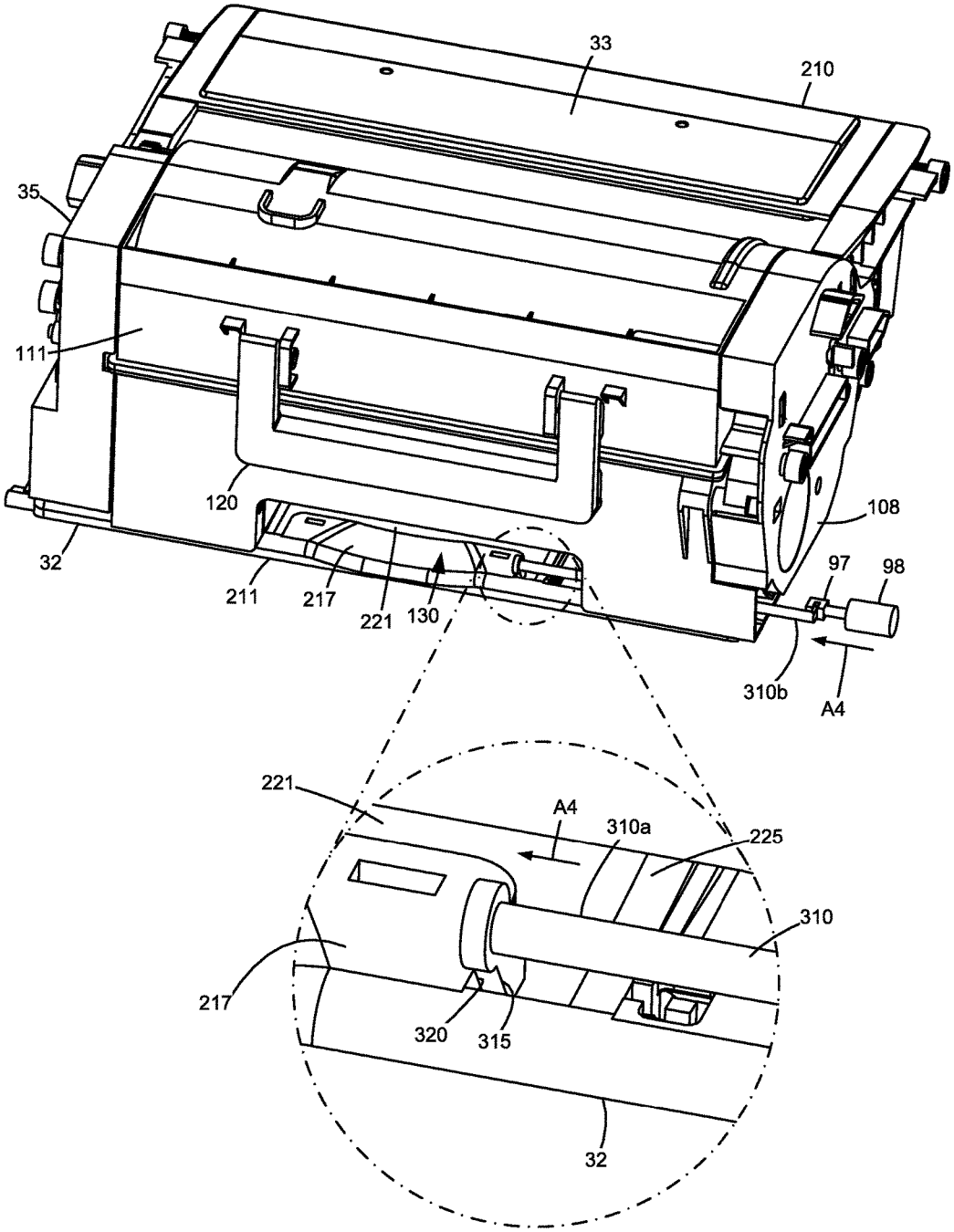

With reference to FIGS. 13A and 13B, another example embodiment of a system for locking toner cartridge 35 and imaging unit 32 together is illustrated. In this embodiment, toner cartridge 35 includes a slide lock mechanism having a translatable latch that is insertable into a corresponding catch located on imaging unit 32. In the example shown, toner cartridge 35 includes a shaft 310 translatably mounted on housing 102 and laterally movable along direction D1. Shaft 310 has a first end 310*a* extending into cavity 130 of toner cartridge 35 and a second end 310*b* extending outward from side 108 of toner cartridge 35. First end 310*a* of shaft 310 includes a first arm portion 315 attached thereto and a second arm portion 317 depending from first arm portion 315. Second arm portion 317 aligns with a hole 320 formed on base 217 of imaging unit 32 when toner cartridge 35 is mated with imaging unit 32. Second end 310*b* of shaft 310 includes a shim 312 that is received by a catch member 97 in image forming device 22 when toner cartridge 35 is installed in image forming device 22. Catch member 97 is movable by a solenoid 98 in image forming device 22 along direction D1. In particular, solenoid 98 is communicatively coupled to and activated by controller 28 to linearly move catch member 97 toward or away from side 108 of toner cartridge 35 in order to translate shaft 310 in direction D1 and move second arm portion 317 between an unlatched position shown in FIG. 13A and a latched position shown in FIG. 13B relative to hole 320 of imaging unit 32. In the unlatched position, second arm portion 317 is disengaged from hole 320 of imaging unit 32 allowing toner cartridge 35 and imaging unit 32 to be separately removed from image forming device 22. When catch member 97 is moved by solenoid 98 towards side 108 of toner cartridge 35, second arm portion 317 translates in direction A4 to the latched position and is inserted into hole 320 as shown in FIG. 13B such that imaging unit 32 and toner cartridge 35 are coupled to each other and removable from image forming device 22 as a single unit.

In the example embodiments illustrated in FIGS. 10-13B, toner cartridge 35 may include projections, such as projections 142, or other stability features and imaging unit 32 may include a pocket, such as pocket 232, or other stability features that aid in retaining imaging unit 32 against toner cartridge 35 when imaging unit 32 and toner cartridge 35 are removed from image forming device 22 as a single unit.

The configurations for automatic latching between toner cartridge 35 and imaging unit 32 based on a detected error condition to allow removal of imaging unit 32 and toner cartridge 35 from image forming device 22 as a single unit are not limited to the example embodiments illustrated. Other configurations are possible. For example, latch features on toner cartridge 35 and/or imaging unit 32, generally designated as latch assembly 140, may be actuated by any suitable means such as by using magnets and other electromechanical devices (e.g., solenoids and motors). In addition, latch features on toner cartridge 35 may engage other exposed portions of imaging unit 32, or vice versa, to lock toner cartridge 35 and imaging unit 32 together. For example, latch features, such as one or more latches or latch catches, may be disposed on any location on top 106, bottom 107, front 110, rear 111, and/or sides 108, 109 of toner cartridge 35 and corresponding latch features may be present on an adjacent portion of imaging unit 32.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A replaceable unit for an electrophotographic image forming device, comprising:

a housing having a reservoir for holding toner;

a movable latch on the housing positioned to engage a corresponding latch catch on a second replaceable unit of the image forming device for selectively coupling and decoupling the replaceable unit and the second replaceable unit such that the replaceable unit and the second replaceable unit are removable from the image forming device as a single unit when the replaceable unit and the second replaceable unit are coupled and the replaceable unit and the second replaceable unit are separately removable from the image forming device when the replaceable unit and the second replaceable unit are decoupled; and a drive interface operatively connected to the latch and exposed on the housing to engage a drive member of the image forming device when the replaceable unit is installed in the image forming device to receive an actuation force from the drive member of the image forming device for actuating the latch to selectively couple and decouple the replaceable unit and the second replaceable unit when the replaceable unit and the second replaceable unit are installed in the image forming device, wherein the drive interface includes a drive gear operatively connected to the latch and exposed on the housing.

2. The replaceable unit of claim 1, wherein the replaceable unit is a toner cartridge having a toner reservoir and an outlet in fluid communication with the toner reservoir for exiting toner from the toner cartridge and the second replaceable unit is an imaging unit having an inlet for receiving toner from the outlet of the toner cartridge.

3. The replaceable unit of claim 1, wherein the second replaceable unit is a toner cartridge having a toner reservoir and an outlet in fluid communication with the toner reservoir for exiting toner from the toner cartridge and the replaceable unit is an imaging unit having an inlet for receiving toner from the outlet of the toner cartridge.

4. The replaceable unit of claim 1, wherein the latch is rotatable between a latched position and an unlatched position, in the latched position the latch engages the corresponding latch catch on the second replaceable unit, in the unlatched position the latch disengages from the corresponding latch catch on the second replaceable unit.

5. The replaceable unit of claim 1, wherein the latch is translatable between a latched position and an unlatched position, in the latched position the latch is inserted into the corresponding latch catch on the second replaceable unit, in the unlatched position the latch is removed from the corresponding latch catch on the second replaceable unit.

6. An imaging system for an electrophotographic image forming device, comprising:

a replaceable toner cartridge having a toner reservoir and an outlet in fluid communication with the toner reservoir for exiting toner from the toner cartridge;

a replaceable imaging unit having an inlet for receiving toner from the outlet of the toner cartridge;

a latch movable between a latched position and an unlatched position, in the latched position the latch couples the toner cartridge and the imaging unit together such that the toner cartridge and the imaging unit are removable from the image forming device as a single unit, in the unlatched position the toner cartridge and the imaging unit are decoupled such that the toner cartridge and the imaging unit are separately removable from the image forming device;

a latch actuator operatively engaged with the latch for moving the latch between the latched and unlatched positions; and a controller configured to detect an error condition that requires removal of both the toner cartridge and the imaging unit from the image forming device and, in response to detecting the error condition, to cause the latch actuator to move the latch from the unlatched position to the latched position to permit removal of the toner cartridge and the imaging unit from the image forming device as a single unit, wherein the error condition includes a media jam in a predetermined area along a media path within the image forming device.

7. The imaging system of claim 6, wherein the latch is movably mounted on the toner cartridge and the imaging unit includes a latch catch positioned to receive the latch when the latch is in the latched position in order to couple the toner cartridge and the imaging unit together and permit removal of the toner cartridge and the imaging unit from the image forming device as a single unit.

8. The imaging system of claim 6, wherein the latch is movably mounted on the imaging unit and the toner cartridge includes a latch catch positioned to receive the latch when the latch is in the latched position in order to couple the toner cartridge and the imaging unit together and permit removal of the toner cartridge and the imaging unit from the image forming device as a single unit.

9. The imaging system of claim 6, wherein the latch includes a rotatable latch mounted on one of the toner cartridge and the imaging unit, in the latched position the latch engages a corresponding latch catch on the other of the toner cartridge and the imaging unit, in the unlatched position the latch disengages from the corresponding latch catch on the other of the toner cartridge and the imaging unit.

10. The imaging system of claim 6, wherein the latch includes a translatable latch mounted on one of the toner cartridge and the imaging unit, in the latched position the latch is inserted into a corresponding latch catch on the other of the toner cartridge and the imaging unit, in the unlatched position the latch is removed from the corresponding latch catch on the other of the toner cartridge and the imaging unit.

11. An imaging system for an electrophotographic image forming device, comprising:

a replaceable toner cartridge having a toner reservoir and an outlet in fluid communication with the toner reservoir for exiting toner from the toner cartridge;

a replaceable imaging unit having an inlet for receiving toner from the outlet of the toner cartridge;

a movable latch positioned to selectively couple the toner cartridge and the imaging unit together such that the toner cartridge and the imaging unit are removable from the image forming device as a single unit and to selectively decouple the toner cartridge and the imaging unit such that the toner cartridge and the imaging unit are separately removable from the image forming device; and a controller configured to actuate the latch to couple the toner cartridge and the imaging unit together in response to the controller detecting an error condition requiring removal of both the toner cartridge and the imaging unit from the image forming device in order to permit removal of the toner cartridge and the imaging unit from the image forming device as a single unit, wherein the error condition includes a media jam in a predetermined area along a media path within the image forming device.

12. The imaging system of claim 11, wherein the latch is positioned on the toner cartridge and the imaging unit includes a latch catch that receives the latch when the controller actuates the latch.

13. The imaging system of claim 11, wherein the latch is positioned on the imaging unit and the toner cartridge includes a latch catch that receives the latch when the controller actuates the latch.

14. The imaging system of claim 11, wherein the latch includes a rotatable latch that is mounted on one of the toner cartridge and the imaging unit and that is rotatable between a latched position and an unlatched position, in the latched position the latch engages a corresponding latch catch on the other of the toner cartridge and the imaging unit, in the unlatched position the latch disengages from the corresponding latch catch on the other of the toner cartridge and the imaging unit.

15. The imaging system of claim 11, wherein the latch includes a translatable latch that is mounted on one of the toner cartridge and the imaging unit and that is translatable between a latched position and an unlatched position, in the latched position the latch is inserted into a corresponding latch catch on the other of the toner cartridge and the imaging unit, in the unlatched position the latch is removed from the corresponding latch catch on the other of the toner cartridge and the imaging unit.

16. A method for controlling an imaging system of an electrophotographic image forming device having a toner cartridge mated with an imaging unit when the toner cartridge and the imaging unit are installed in the image forming device, the method comprising;

detecting, by the image forming device, an error condition that requires removal of both the toner cartridge and the imaging unit from the image forming device;

in response to detecting the error condition, the image forming device, automatically coupling the toner cartridge and the imaging unit together such that the toner cartridge and the imaging unit are removable from the image forming device as a single units;

determining, by the image forming device, whether the error condition has been corrected and whether the toner cartridge and the imaging unit have been reinstalled in the image forming device following removal of the toner cartridge and the imaging unit from the image forming device as a single unit; and in response to determining that the error condition has been corrected and that the toner cartridge and the imaging unit have been reinstalled in the image forming device, the image forming device automatically decoupling the toner cartridge from the imaging unit such that the toner cartridge and the imaging unit are separately removable from the image forming device.

17. The method of claim 16, wherein the detecting the error condition includes detecting a media jam in the image forming device.

18. A replaceable unit for an electrophotographic image forming device, comprising:

a housing having a reservoir for holding toner;

a movable latch on the housing positioned to engage a corresponding latch catch on a second replaceable unit of the image forming device for selectively coupling and decoupling the replaceable unit and the second replaceable unit such that the replaceable unit and the second replaceable unit are removable from the image forming device as a single unit when the replaceable unit and the second replaceable unit are coupled and the replaceable unit and the second replaceable unit are separately removable from the image forming device when the replaceable unit and the second replaceable unit are decoupled; and a drive interface operatively connected to the latch and exposed on the housing to engage a drive member of the image forming device when the replaceable unit is installed in the image forming device to receive an actuation force from the drive member of the image forming device for actuating the latch to selectively couple and decouple the replaceable unit and the second replaceable unit when the replaceable unit and the second replaceable unit are installed in the image forming device, wherein the latch is translatable between a latched position and an unlatched position, in the latched position the latch is inserted into the corresponding latch catch on the second replaceable unit, in the unlatched position the latch is removed from the corresponding latch catch on the second replaceable unit.

19. An imaging system for an electrophotographic image forming device, comprising:

a replaceable toner cartridge having a toner reservoir and an outlet in fluid communication with the toner reservoir for exiting toner from the toner cartridge;

a replaceable imaging unit having an inlet for receiving toner from the outlet of the toner cartridge;

a latch movable between a latched position and an unlatched position, in the latched position the latch couples the toner cartridge and the imaging unit together such that the toner cartridge and the imaging unit are removable from the image forming device as a single unit, in the unlatched position the toner cartridge and the imaging unit are decoupled such that the toner cartridge and the imaging unit are separately removable from the image forming device;

a latch actuator operatively engaged with the latch for moving the latch between the latched and unlatched positions; and a controller configured to detect an error condition that requires removal of both the toner cartridge and the imaging unit from the image forming device and, in response to detecting the error condition, to cause the latch actuator to move the latch from the unlatched position to the latched position to permit removal of the toner cartridge and the imaging unit from the image forming device as a single unit, wherein the latch includes a translatable latch mounted on one of the toner cartridge and the imaging unit, in the latched position the latch is inserted into a corresponding latch catch on the other of the toner cartridge and the imaging unit, in the unlatched position the latch is removed from the corresponding latch catch on the other of the toner cartridge and the imaging unit.

20. An imaging system for an electrophotographic image forming device, comprising:

a replaceable toner cartridge having a toner reservoir and an outlet in fluid communication with the toner reservoir for exiting toner from the toner cartridge;

a replaceable imaging unit having an inlet for receiving toner from the outlet of the toner cartridge;

a movable latch positioned to selectively couple the toner cartridge and the imaging unit together such that the toner cartridge and the imaging unit are removable from the image forming device as a single unit and to selectively decouple the toner cartridge and the imaging unit such that the toner cartridge and the imaging unit are separately removable from the image forming device; and a controller configured to actuate the latch to couple the toner cartridge and the imaging unit together in response to the controller detecting an error condition requiring removal of both the toner cartridge and the imaging unit from the image forming device in order to permit removal of the toner cartridge and the imaging unit from the image forming device as a single unit, wherein the latch includes a translatable latch that is mounted on one of the toner cartridge and the imaging unit and that is translatable between a latched position and an unlatched position, in the latched position the latch is inserted into a corresponding latch catch on the other of the toner cartridge and the imaging unit, in the unlatched position the latch is removed from the corresponding latch catch on the other of the toner cartridge and the imaging unit.

21. A method for controlling an imaging system of an electrophotographic image forming device having a toner cartridge mated with an imaging unit when the toner cartridge and the imaging unit are installed in the image forming device, the method comprising;

detecting, by the image forming device, an error condition that requires removal of both the toner cartridge and the imaging unit from the image forming device; and in response to detecting the error condition, the image forming device, automatically coupling the toner cartridge and the imaging unit together such that the toner cartridge and the imaging unit are removable from the image forming device as a single unit, wherein the detecting the error condition includes detecting a media jam in the image forming device.

* * * * *